US008347577B2

(12) United States Patent
Aboukhalil

(10) Patent No.: US 8,347,577 B2
(45) Date of Patent: Jan. 8, 2013

(54) RECESSED REVEAL WALL PANEL SYSTEM

(76) Inventor: Charbel Tannious Aboukhalil, Grand Terrace, CA (US)

( * ) Notice: Subject to any disclaimer, the term of this patent is extended or adjusted under 35 U.S.C. 154(b) by 0 days.

(21) Appl. No.: 13/149,143

(22) Filed: May 31, 2011

(65) Prior Publication Data

US 2012/0304572 A1 Dec. 6, 2012

(51) Int. Cl.
*E04B 2/30* (2006.01)

(52) U.S. Cl. ..... 52/489.1; 52/302.1; 52/386; 52/475.1; 52/506.05; 52/508; 52/510; 52/211; 52/762

(58) Field of Classification Search ..... 52/235, 52/302.1, 302.3, 385, 386, 475.1, 483.1, 52/489.1, 506.06, 506.08, 509–513, 579, 52/586.1, 762, 764, 506.05, 508, 489.2, 779
See application file for complete search history.

(56) References Cited

U.S. PATENT DOCUMENTS

| | | | | |
|---|---|---|---|---|
| 3,085,301 | A | 4/1963 | Nuorivaara | |
| 4,457,249 | A | 7/1984 | Disen | |
| 5,941,040 | A * | 8/1999 | McAnallen et al. | 52/586.1 |
| 6,202,377 | B1 | 3/2001 | Krieger | |
| 7,937,902 | B1 * | 5/2011 | Smith et al. | 52/235 |
| 8,033,066 | B2 * | 10/2011 | Griffiths | 52/235 |
| 8,127,507 | B1 * | 3/2012 | Bilge | 52/235 |
| 2004/0139676 | A1 | 7/2004 | Knauseder | |
| 2009/0241444 | A1 * | 10/2009 | Griffiths | 52/235 |
| 2010/0263314 | A1 * | 10/2010 | Macdonald et al. | 52/506.05 |

FOREIGN PATENT DOCUMENTS

| | | |
|---|---|---|
| DE | 19828480 | 12/1999 |
| EP | 0659953 | 6/1995 |

OTHER PUBLICATIONS

Information from ktron.com regarding wood based extruded material dated May 9, 2009 from the internet wayback machine at: http://web.archive.org/web/20090509103903/http://www.ktron.com/industries_served/Plastics/WoodPlastic.cfm.*

* cited by examiner

*Primary Examiner* — Brian Glessner
*Assistant Examiner* — Brian D Mattei
(74) *Attorney, Agent, or Firm* — Stetina Brunda Garred & Brucker

(57) ABSTRACT

An eco-friendly wall panel system may comprise a plurality of panels, horizontal joints and panel clips which are all fabricated from the same sheet of material. For example, the panels may initially be fabricated from the phenolic sheets. After the maximum quantity of panels has been fabricated from any one sheet, the remaining portion of the phenolic sheet may be used to fabricate the horizontal runners and the panel clips which may be smaller than the panels. As such, as much of the phenolic sheet is being used to fabricate the system. Hence, the process and the product are both eco-friendly.

12 Claims, 11 Drawing Sheets

RECESSED REVEAL WALL PANEL SYSTEM

CROSS-REFERENCE TO RELATED APPLICATIONS

Not Applicable

STATEMENT RE: FEDERALLY SPONSORED RESEARCH/DEVELOPMENT

Not Applicable

BACKGROUND

The embodiments disclosed herein relate to a plurality of wall panels mountable to a wall or ceiling.

Prior art wall panel systems include a plurality of panels that are arranged in rows and columns. These panels are mounted to a wall or ceiling by connecting panel clips to the backside of the panels and attaching horizontal and vertical runners to the wall. The panel clips engage the horizontal and vertical runners with a tongue and groove connection.

Unfortunately, the process of manufacturing the panels is not eco-friendly. In particular, the panels are fabricated from a plurality of sheets. In cutting out the plurality of panels from the sheet, the left over portion of the sheet which is too small to cut out any additional panels is discarded. The left over portion is thrown away as waste and fills up our landfills.

Moreover, the horizontal runners, vertical runners and the panel clips are also not eco friendly. The horizontal and vertical runners and the panel clips are typically extruded aluminum. At the end of the useful life of the prior art wall panel system, the horizontal and vertical runners and the panel clips are removed from the wall and discarded as waste which also fills up our landfills.

Accordingly, the process of fabricating the panel system and the system itself is not eco-friendly. Hence, there is a need in the art for an eco-friendly wall panel system.

BRIEF SUMMARY

The embodiments disclosed herein address the needs discussed above, discussed below and those that are known in the art.

A recessed reveal wall panel system which includes a plurality of wall panels that are mounted to a wall or ceiling is disclosed herein. The plurality of panels may be mounted to the wall or ceiling with a plurality of horizontal joints and panel clips. These horizontal joints and panel clips may be fabricated from the same material as the plurality of panels. For example, the plurality of panels may be cut out from sheets of an eco-friendly material (e.g., phenolic). After the panels are cut out from the sheets, the remaining portion of the sheet may be used to fabricate the horizontal runners and the panel clips. In this manner, most of sheet is utilized during the process of fabricating the wall panel system and waste is minimized. Accordingly, the process and product are eco-friendly.

More particularly, a method of manufacturing a wall panel kit is disclosed. The method may comprise the steps of providing one or more rigid sheets all fabricated from one type of material (e.g., phenolic or other eco friendly material); cutting a plurality of panels and at least one joint or panel clip from the one or more rigid sheets; wherein the panel clip is attachable to the panel and the joint is attachable to a wall for joining the panel to the wall.

The cutting step may include the step of cutting the one or more sheets into rectangular panels.

The cutting step may also include the steps of cutting horizontal joints from the one or more sheets, the horizontal joints being longer than the width of the panel and cutting upper and lower grooves in opposed longitudinal surfaces of the horizontal joints; and cutting vertical joints from the one or more sheets, the vertical joints being shorter than a height of the panels. The upper and lower grooves of the horizontal joints may be formed with a shaper.

The cutting step may also include the steps of cutting horizontal edge joints from the one or more sheets; and cutting a first groove in one of opposed longitudinal surfaces of the horizontal edge joints.

In the method, the panel clips are attached to the panels. The joints are attached to the wall.

In another aspect of the wall panel system, a paneled wall is disclosed. The paneled wall may comprise a plurality of wall panels and a plurality of horizontal joints. The plurality of wall panels may be fabricated a wood based material such as phenolic. The wall panels may be arranged in a series of rows and columns on the wall. Each of the wall panels may be disposed parallel to the wall. Each of the wall panels may have an upper panel clip defining an upwardly directed tongue. The upper panel clips may be attached to a back side of the panels at upper edge portions of the panels. Also, a lower panel clip may define a downwardly directed tongue. The lower panel clip may be attached to the back side of the panels at lower edge portions of the panels.

The plurality of horizontal joints fabricated from the wood based material may each have a length greater than a width of one of the panels. Each horizontal joint may define upper and lower longitudinal surfaces. The upper longitudinal surface may have an upper groove. The lower longitudinal surface may have a lower groove. The horizontal joints may be attached to the wall horizontal to the ground and parallel to the other horizontal joint(s). The tongue of the lower clip may be received into the upper groove of the horizontal joint. The tongue of the upper clip may be received into the lower groove of the horizontal joint.

The wood based material of the wall panels and the horizontal joints may be phenolic.

The wall panels, horizontal joints and panel clips may have identical thicknesses.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
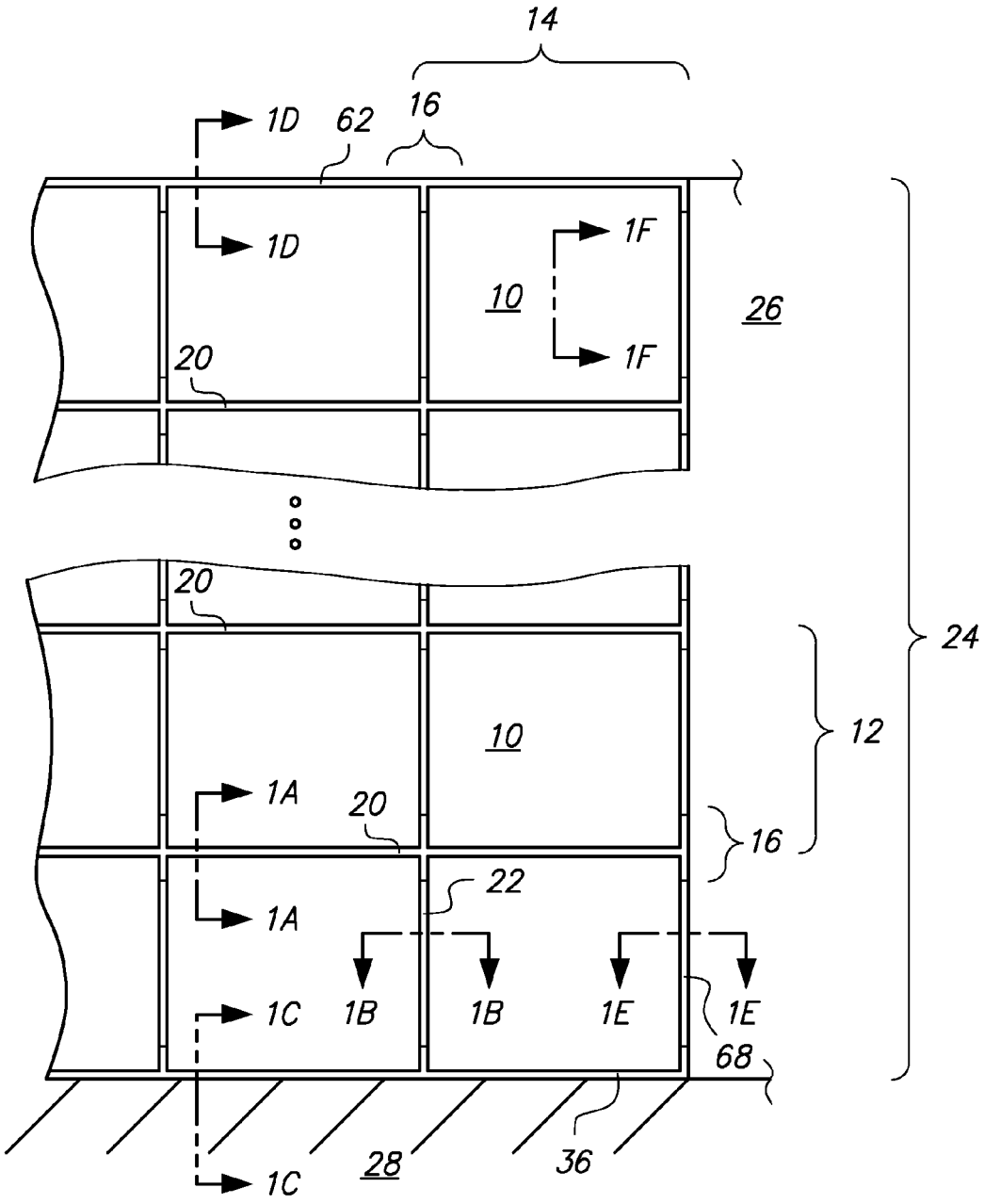
FIG. 1 is a plan view of a recessed reveal wall panel system mounted to a wall.

Referring now to the drawings, a plurality of panels 10 arranged in rows and columns 12, 14 are shown. The adjacent edges 16 of adjacent panels 10 have a recessed look which are shown in FIGS. 1A and 1B. Adjacent panels 10 have a vertical or horizontal gap 18 so that adjacent edges 16 of adjacent panels 10 show an underlining horizontal joint 20 or vertical joint 22. The horizontal and vertical joints 20, 22 may be fabricated from the same material as the panel 10 and also have the same aesthetic qualities as the panels 10. In this manner, a recessed aesthetic feel is produced when looking at the wall panel system 24 comprised of the plurality of panels 10. The plurality of panels 10 and the horizontal and vertical joints 20, 22 may be fabricated from the same type of material. Preferably, the material is an eco-friendly material such as phenolic (i.e. wood chips hardened in resin). To manufacture a kit of the system 24, sheets of phenolic may be provided. From these sheets of phenolic, the rectangular panels 10 are cut to size. After the panels 10 are cut, the left over pieces of phenolic which are too small to fabricate additional monolithic panels 10 are used for the horizontal and vertical joints 20, 22. In this manner, use of the phenolic sheets is maximized and waste is minimized. Accordingly, the kit utilizes an eco-friendly material (e.g., phenolic). Also, the method by which the parts of the kit are produced minimizes waste and is also an eco-friendly process.

Figure 1A:
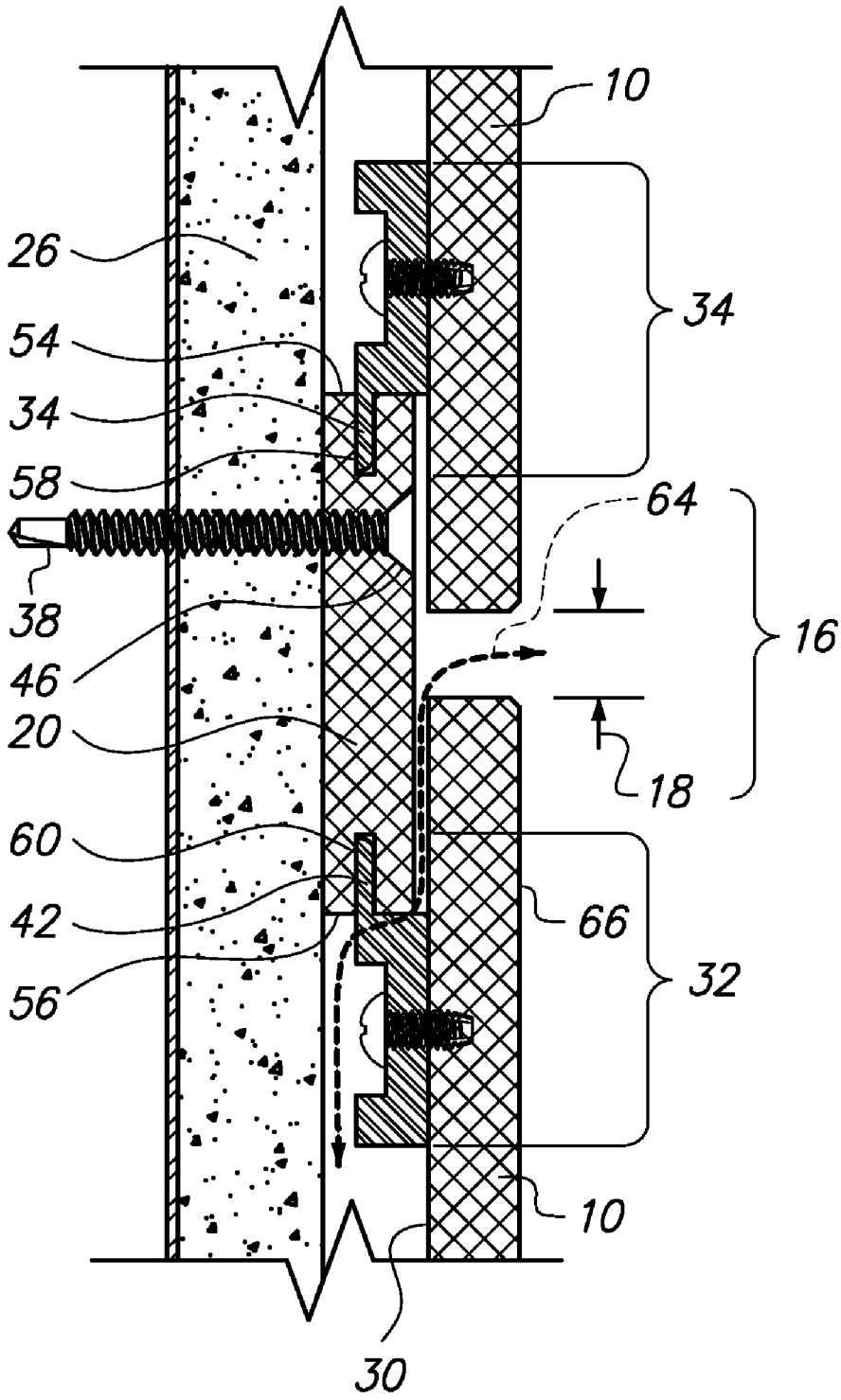
FIG. 1A is a cross-sectional view of a horizontal joint of the system shown in FIG. 1.
Figure 1B:
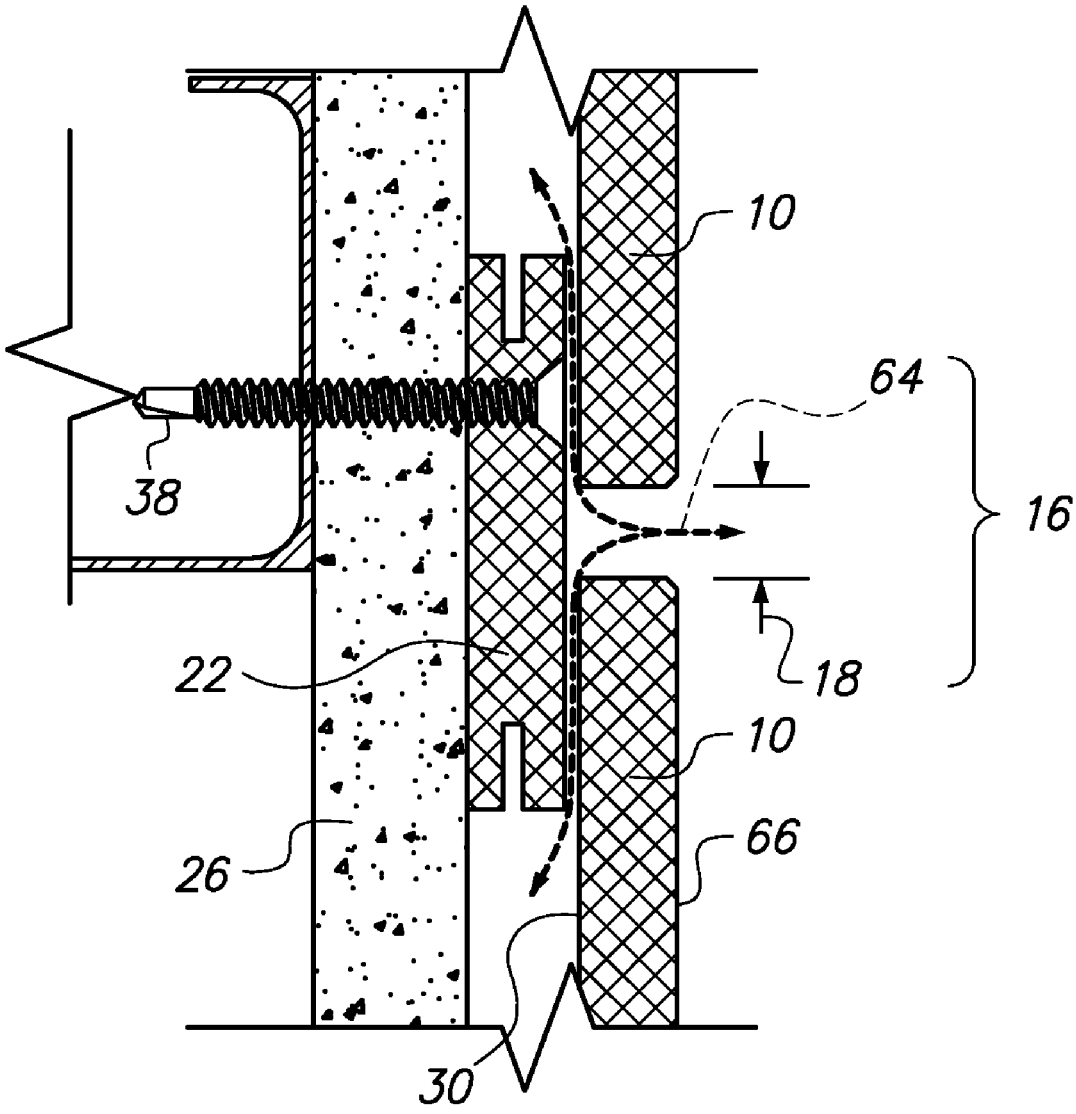
FIG. 1B is a cross-sectional view of a vertical joint of the system shown in FIG. 1.

More particularly, referring now to FIG. 1, the panels 10 are attached to the wall 26 by way of a plurality of horizontal joints 20. The horizontal joints 20 are spaced apart and are parallel to each other and generally horizontal to the ground 28. Upper and lower horizontal clips 32, 34 may be attached to the backside 30 of each of the panels 10 that engage the horizontal joints 20 in a tongue and groove fashion to mount the panels 10 to the wall 26 (see FIG. 1A).

Figure 1C:
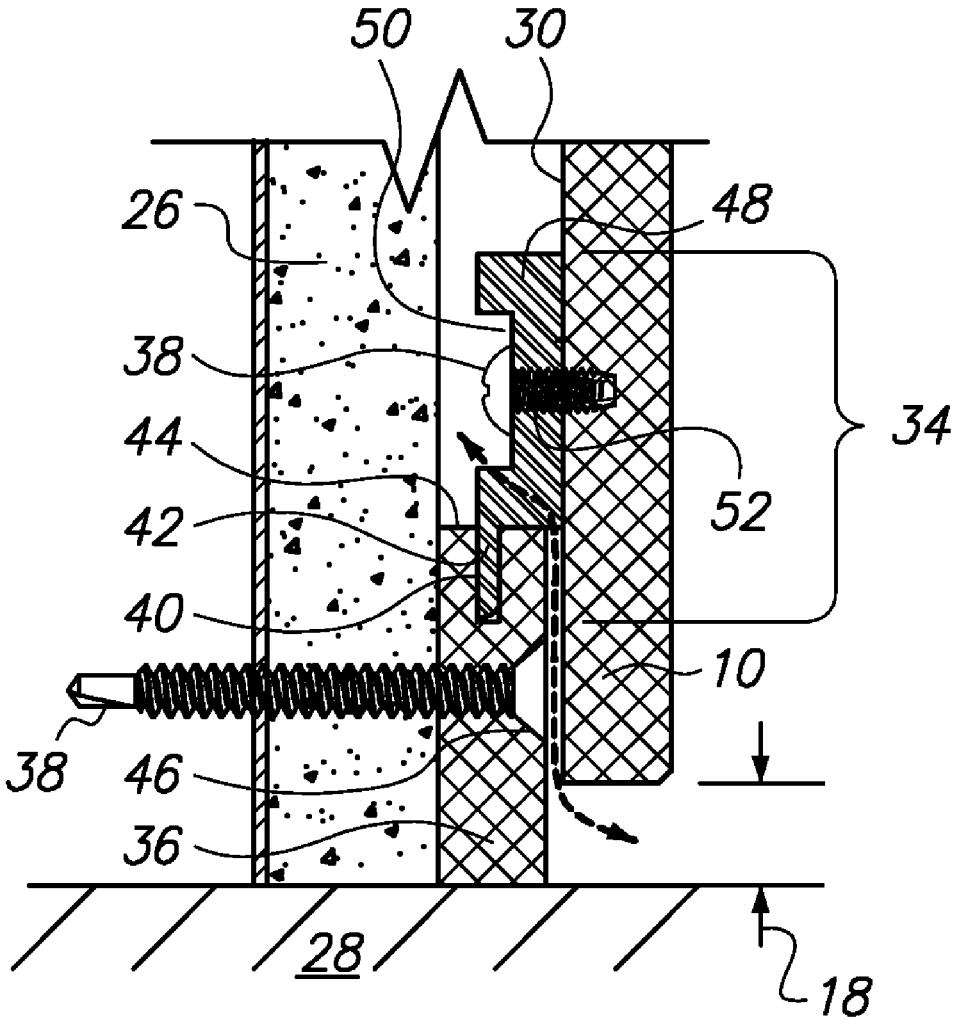
FIG. 1C is a cross-sectional view of a bottom-edge joint of the system shown in FIG. 1.

To begin mounting the wall panel system 24 to the wall 26, referring to FIG. 1C, a bottom horizontal edge joint 36 is attached to the wall 26 with one or more screws 38 along the length of the joint 36. The bottom horizontal edge joint 36 preferably is horizontal to the ground 28 and extends the full length of the row of panels 10 as shown in FIG. 1. The bottom horizontal edge joint 36 may have a single groove 40 formed on the upper side that extends along the entire length of the bottom horizontal edge joint 36. The groove 40 of the bottom horizontal edge joint 36 may receive a tongue 42 of a lower horizontal clip 34. The groove 40 of the bottom horizontal edge joint 36 may be formed in the upper longitudinal surface 44 of the bottom horizontal edge joint 36. The bottom horizontal edge joint 36 may also have a plurality of countersink holes 46 along the length of the bottom horizontal edge joint 36. One or more screws 38 are fitted within the countersink holes 46 and attached to the wall 26 to attach the bottom horizontal edge joint 36 to the wall 26. A gap 18 reveals the underlying bottom edge joint 36. The components can be adjusted so that the gap 18 is between 1/16" to 12".

Referring back to FIG. 1, the bottom most row 12 of panels 10 are laid adjacent to the ground 28 on the bottom horizontal edge joint 36. Referring back to FIG. 1C, the panels 10 may have one or more lower horizontal clips 34 attached to the backside 30 of the panels 10. The lower horizontal clip 34 may extend across the entire width of the panel 10 or may be only a few inches long. When short panel clips 34 are used, two lower horizontal clips 34 may be attached to the backside 30 of the panels 10 on the left and right sides of the panel 10, to provide stability when the clips 34 engage the bottom horizontal edge joint 36. The lower horizontal clip 34 may have a base 48 with a channel 50 extending along the length of the lower horizontal clip 34. One or more holes 52 may be formed in the lower horizontal clip 34 at the position of the channel 50 through which screws 38 are inserted and used to attach the clip 34 to the panel 10. After the lower horizontal clips 34 are attached to the panels 10, the tongue 42 of the lower horizontal clip 34 is pushed into the groove 40 of the bottom horizontal edge joint 36. The various components are sized and configured so as to form a gap 18, which is preferably the same size as the gaps 18 shown in FIGS. 1A and 1B. The sizes of the panels 10, vertical joint 22 and the horizontal joint 20 may be enlarged or reduced to adjust the size of the gap 18 which may be between 1/16" to 12".

Referring now to FIG. 1A, each of the panels 10 in the bottom most row 12 panels 10 may have one or more upper horizontal clips 32. The upper horizontal clip 32 may be identical to the lower horizontal clip 34 except that they 32 are positioned at the top of the panel 10 and the tongue 42 of the upper horizontal clip 32 is oriented upwardly instead of downwardly as in the case of the lower horizontal clip 34. With the upper horizontal clip 32 attached to the panel 10 in the same manner as the lower horizontal clip 34 is attached to the panel 10, the horizontal joint 20 is engaged to the upper horizontal clip 32 and secured to the wall 26 as shown in FIG. 1A. More particularly, the horizontal joint 20 may define upper and lower longitudinal surfaces 54, 56. Each of the upper and lower longitudinal surfaces 54, 56, may respectively have an upper groove 58 and a lower groove 60. The grooves 58, 60 may be formed with a shaping machine. The horizontal joint 20 may additionally have a plurality of countersink holes 46 along the length of the horizontal joint 20 which receives screws 38 to attach the joint 20 to the wall 26.

The horizontal joint 20 is laid against the wall 26 and the tongues 42 of the upper horizontal clips 32 of the panels 10 are received in the lower groove 60 of the horizontal joint 20 to lock the bottom most panel 10 in place vertically. Screws 38 are placed in the countersink holes 46 and used to attach the horizontal joint 22 to the wall 26 which locks the bottom most row of panels 10 to the wall 26. The screws 38 are off center and may be positioned behind the panels 10 to hide the screws 38 from plain view.

Referring now to FIG. 1B, behind laterally adjacent vertical edges 16 of adjacent panels 10, a vertical joint 22 may be secured to the wall 26. The vertical joint 22 may have the same cross-sectional configuration as the horizontal joint 20 shown in FIG. 1A. Opposed distal ends of the vertical joint 22 may abut the horizontal joint 20 or the bottom horizontal edge joint 36 or the top horizontal edge joint 62 as shown in FIG. 1. The vertical joint 22 may be fabricated (i.e., cut) from the horizontal joint 20 to save material and manufacturing time as will be discussed further below. The vertical joint 22 does not contact or attach to the panel 10. Rather, the vertical joint 22 provides aesthetic uniformity between the horizontal gap 18 shown in FIG. 1A and the vertical gap 18 shown in FIG. 1B. People view the same material through the gaps 18 in both the horizontal and vertical orientations (see FIGS. 1A and 1B). Screws 38 may be used to attach the vertical joint 22 to the wall 26. The screws 38 may be positioned behind the panel 10 to hide the screws 38 from plain view. The panels 10 may be shifted left or right since the tongues 42 move within the grooves 60. The panels 10 may be adjusted so that the vertical gap 18 (see FIG. 1B) between laterally adjacent panels 10 is equal to the horizontal gap 18 between upper and lower panels 10 (see FIG. 1A). Other configuration are also contemplated. The upper and lower horizontal clips 32, 34 preferably do not extend across the entire width of the panel 10. Rather, one or more upper and lower horizontal clips 32, 34 are attached to each of the panels 10. This allows air to flow to the space between the wall 26 and the panel 10 between two horizontal clips 32 as shown by airflow line 64 (see FIG. 1A). Air is also allowed to flow through the vertical gap 18 and behind the panel 10 shown in FIG. 1B as shown by airflow line 64. This free flow of air equalizes humidity between the front side 66 and the backside 30 of the panel 10 to mitigate warping of the panels 10. There may be at least a 1/16" space to allow for air flow.

Figure 1D:
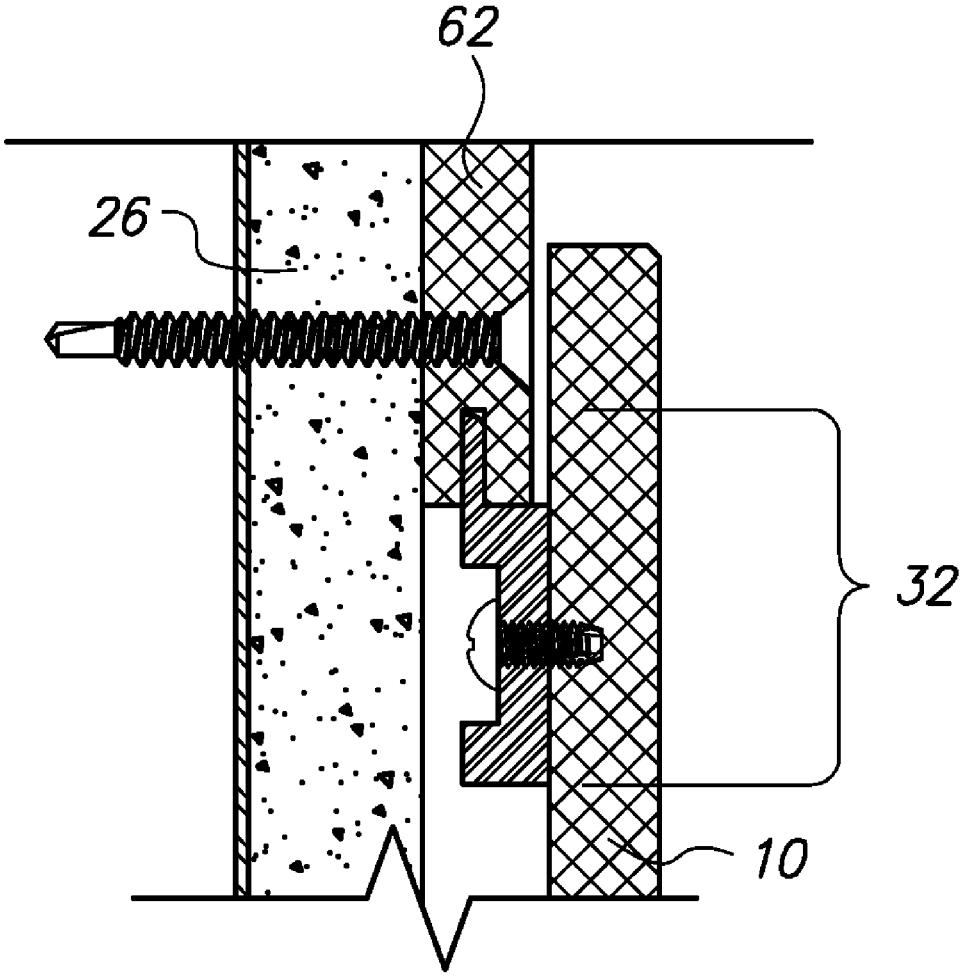
FIG. 1D is a cross-sectional view of a top edge joint of the system shown in FIG. 1.
Figure 1E:
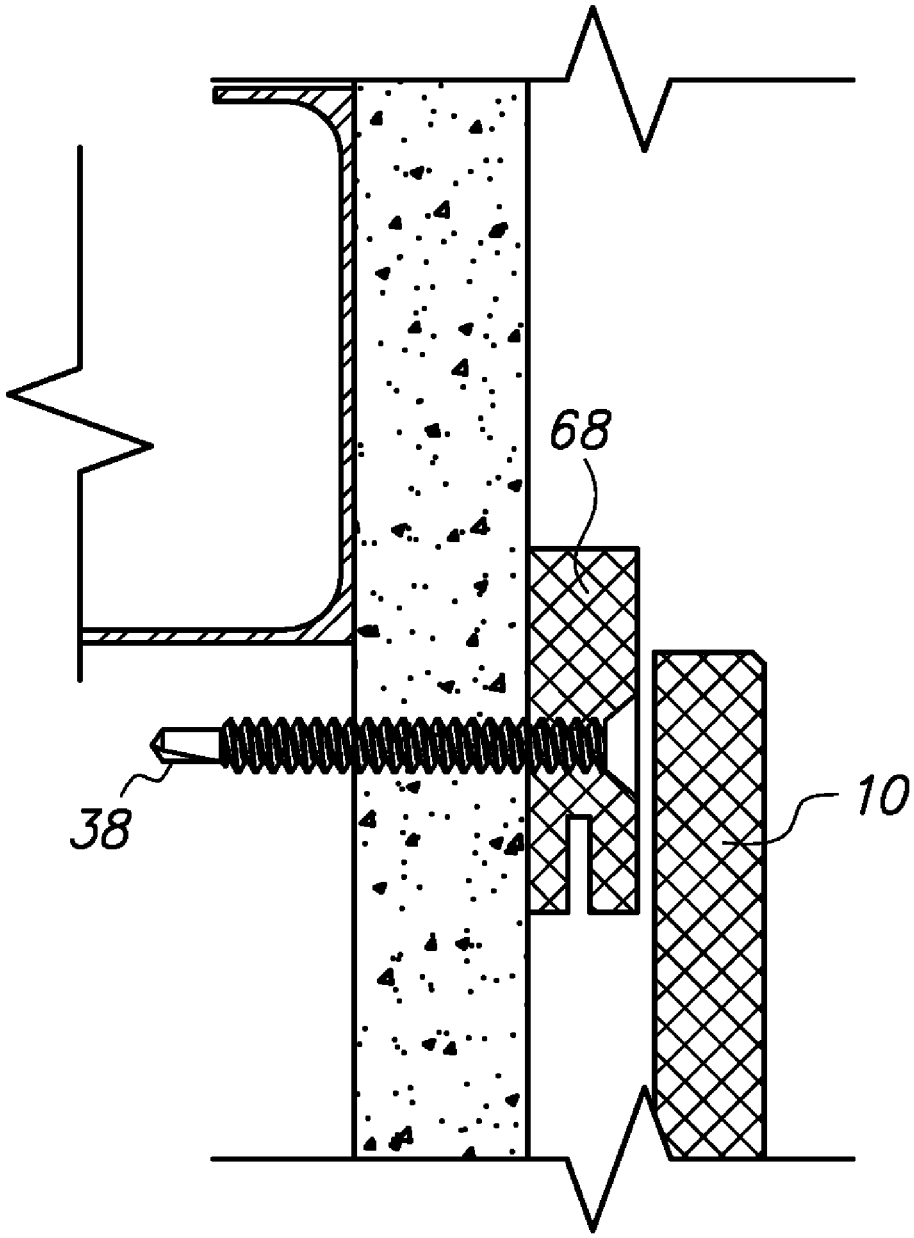
FIG. 1E is a cross-sectional view of a vertical edge joint of the system shown in FIG. 1.

The left and right most panels 10 may also have a vertical edge joint 68 as shown in FIG. 1E. The vertical edge joint 68 may have the same configuration as the bottom horizontal edge joint 36 except that the vertical edge joint 68 is shorter. Also, the vertical edge joint 68 is not attached to the panel 10. The vertical edge joint 68 may extend between and abut horizontal joint 20, bottom edge horizontal edge joint 36 or top horizontal edge joint 62 as shown in FIG. 1. The vertical edge joint 68 may be secured to the left side or right side (as shown) of panel 10 with screws 38 along its length. The screws 38 are hidden behind panels 10. The vertical edge joint 68 may be overlapped by panel 10 to complete the recessed aesthetic look of the wall panel system 24. The revealed size of the vertical joint 68 may be adjusted between 1/16" to 12".

Figure 1F:
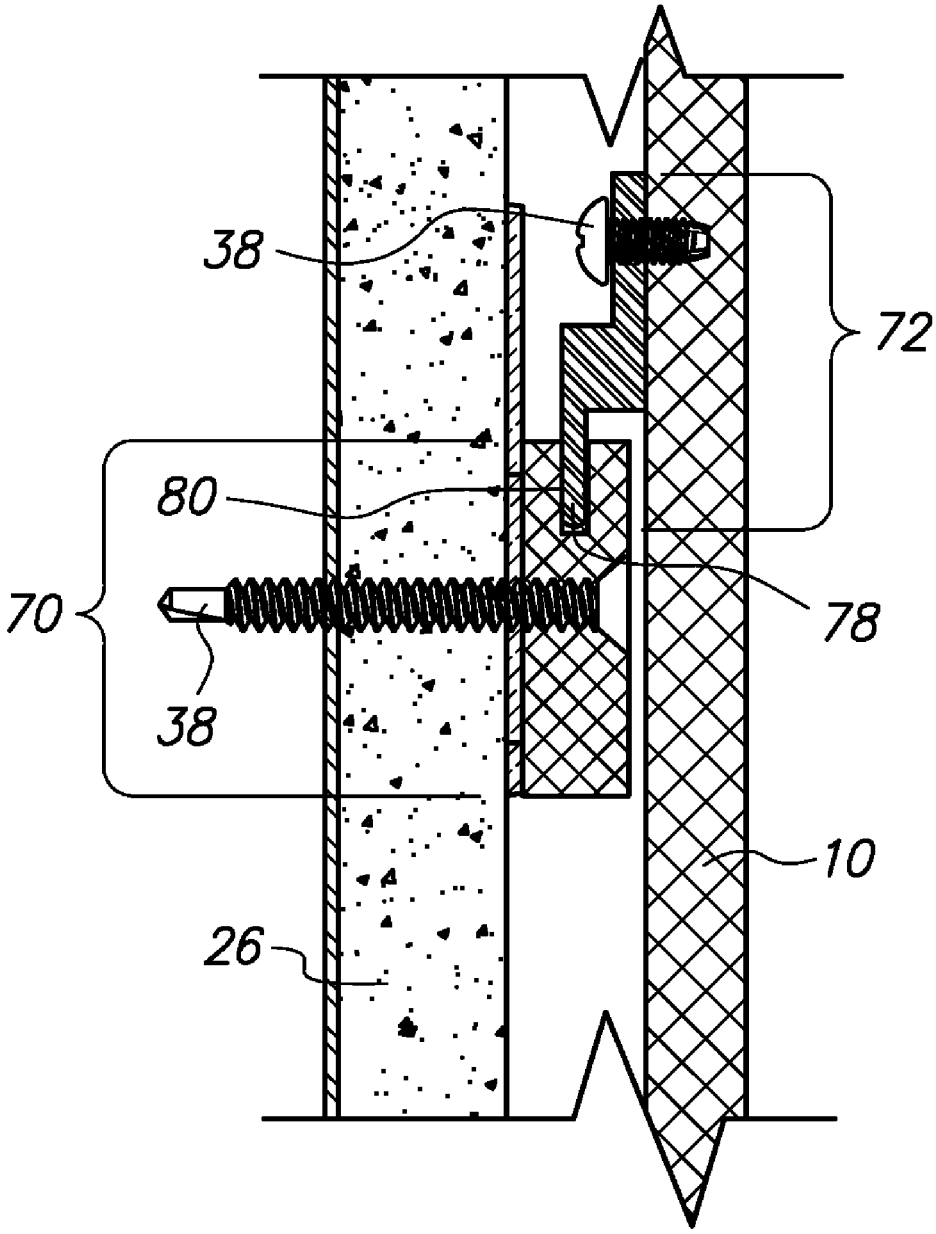
FIG. 1F is a cross-sectional view of a mid panel tongue and groove connection of the system shown in FIG. 1.

Referring now to FIG. 1F, at the middle of one or more of the panels 10, a wall clip 70 and a panel clip 72 may be engage to each other to further reinforce the panel 10. The wall clip 70 and the panel clip 72 may also be fabricated from the same sheet of material that the panels 10, edge joints 36, 62, horizontal joints 20, vertical joints 22 are fabricated so that most of the wall panel system 24 is fabricated from an eco friendly material and also by an eco friendly process. The wall clip 70 may be the same part as the bottom and top edge joints 36, 62 except shorter. The wall clip 70 may be attached to the wall 26 horizontally from the ground 28. The wall clip 70 may only be a short length and not run across the entire length of the panel 10. Likewise, the panel clip 72 may only be a short length. The wall clip 70 and panel clip 72 may be attached to the wall 26 and the panel 10, respectively, with one or more screws 38. A tongue 78 of the panel clip 72 is inserted into a groove 80 of the wall clip 70. Preferably, the wall and panel clips 70, 72 are oriented in the horizontal direction as shown. However, it is also contemplated that they 70, 72 may be oriented in the vertical direction or upside down. The panel clip 72 may have a cross sectional configuration as shown in FIG. 1F. However, the panel clip 72 may be replaced with the panel clip 32, 34.

Figure 2:
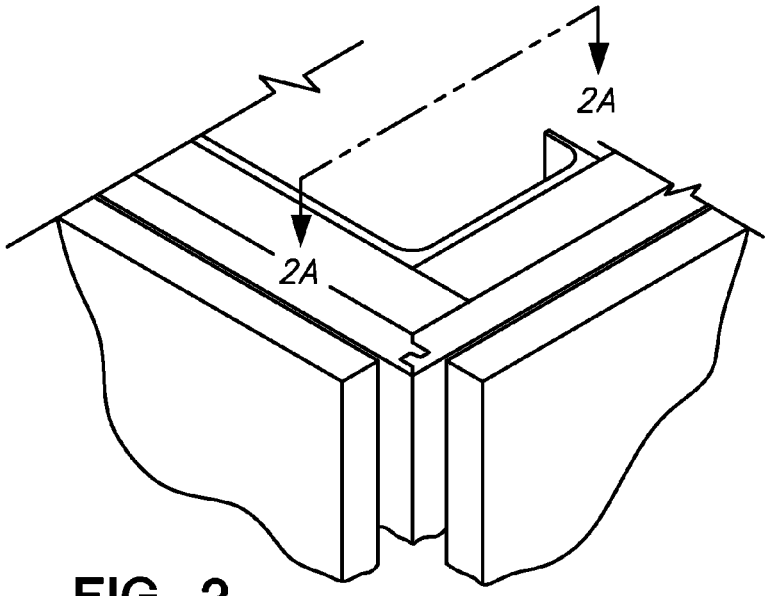
FIG. 2 is a perspective view of a first embodiment of an outside corner of the recessed reveal wall panel system.
Figure 2A:
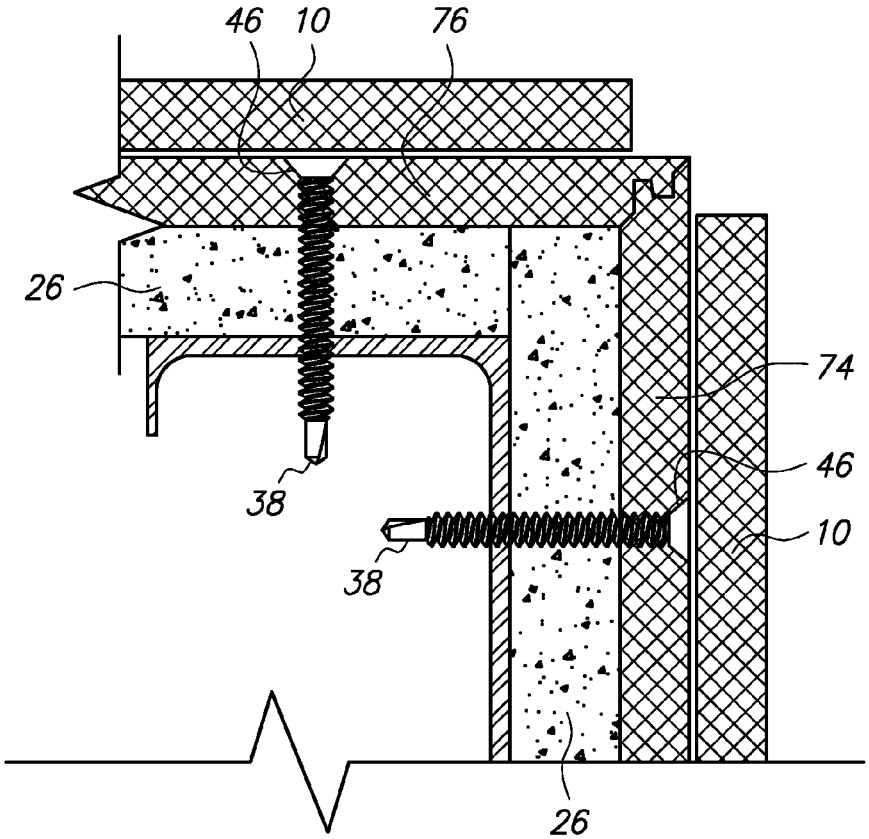
FIG. 2A is top view of the outside corner of the system shown in FIG. 2.

The wall panel system 24 may also be installed on an outside corner shown in FIGS. 2 and 2A. The edge joint 74 may be physically joined to edge joint 76 on the adjacent wall 26. The edge joint 74, 76 may be attached to the wall 26 by way of screws 38 received in countersink holes 46 formed in the edge joint 74, 76. The panels 10 are mounted to the wall 26 as discussed above. The edges of the adjacent panels 10 do not contact or abut each other. This reveals the underlying edge joint 74, 76 to provide a consistent aesthetic look between the front face of the wall 26 and the outside corner. The various components can be adjusted so that more or less of the edge joints 74, 76 are revealed.

Figure 3:
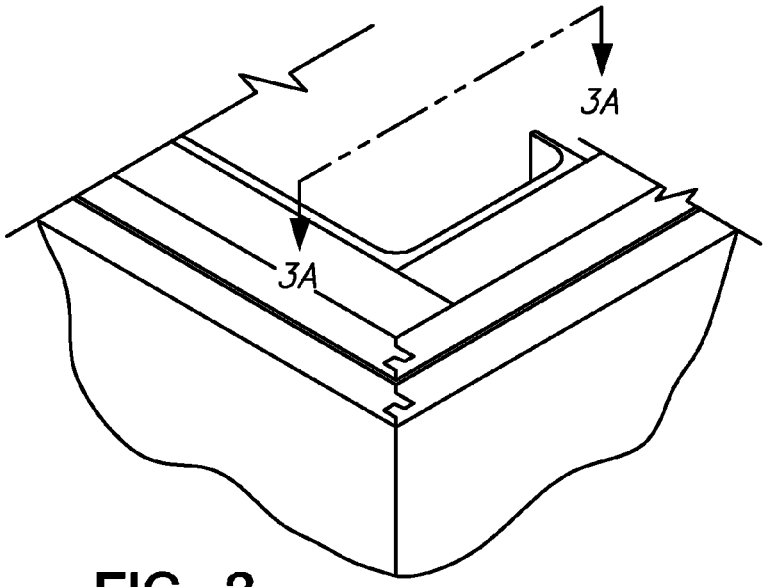
FIG. 3 is a perspective view of a second embodiment of the outside corner of the recessed reveal wall panel system.
Figure 3A:
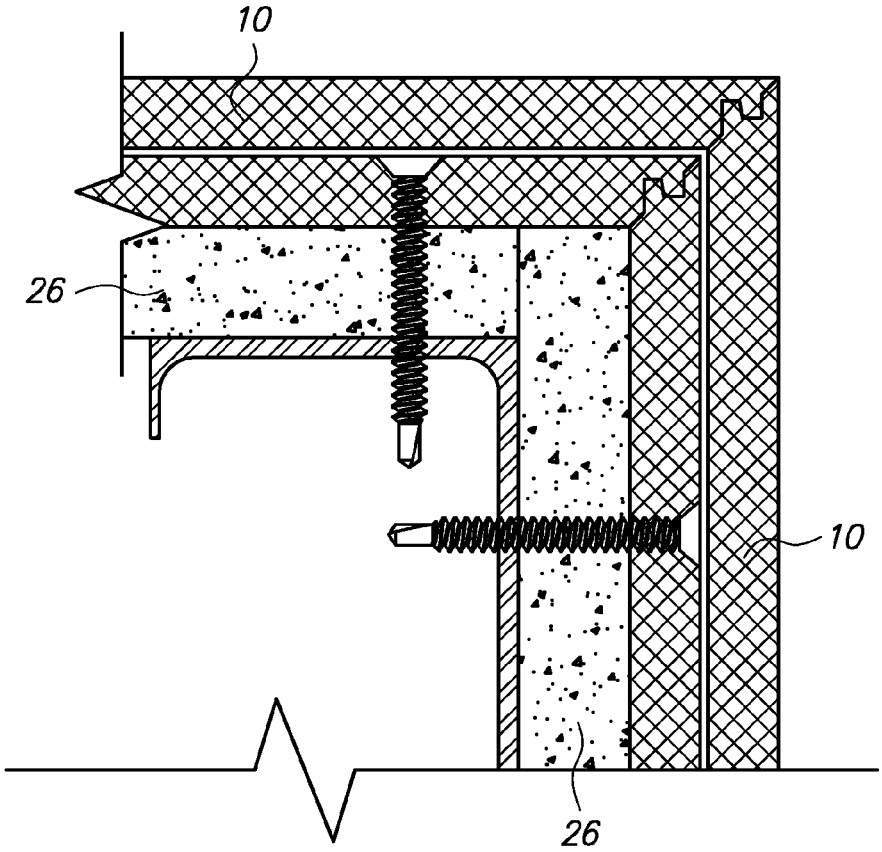
FIG. 3A is a top view of the outside corner of the system shown in FIG. 3.

Referring now to FIGS. 3 and 3A a second embodiment of an outside corner is shown. This second embodiment of the outside has an identical configuration as that shown in FIGS. 2 and 2A except that the adjacent panels 10 interlock with each other. No recess is revealed.

Figure 4:
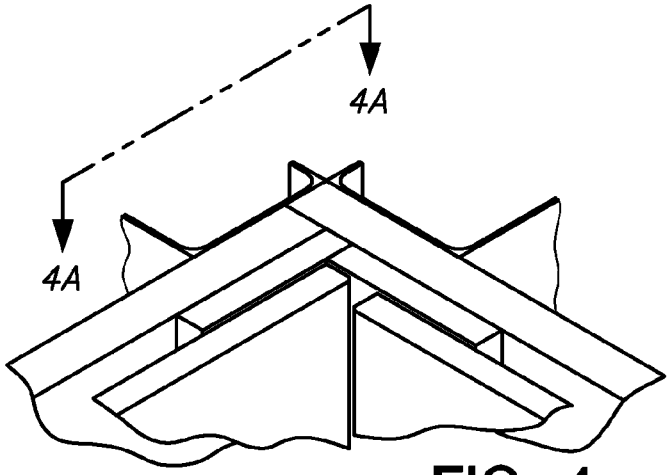
FIG. 4 is a perspective view of an inside corner of the recessed reveal wall panel system.
Figure 4A:
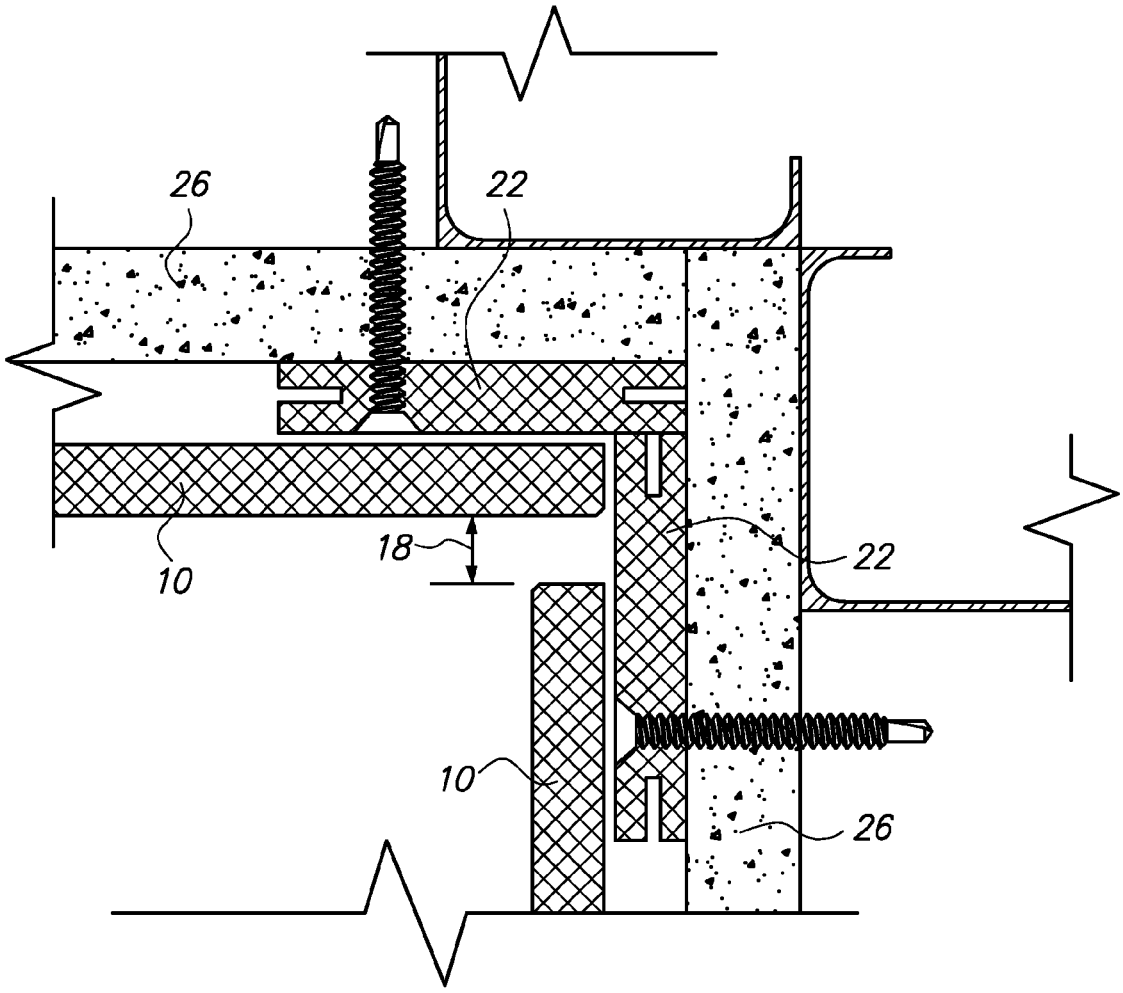
FIG. 4A is a top view of the inside corner of the system shown in FIG. 4.

Referring now to FIGS. 4 and 4A, an inside corner of the wall panel system 24 is shown. The panel 10 that forms the inside corner is attached to the wall 26 in the same manner as discussed above. The inside corner may be fabricated additionally with two vertical joints 22 which may be attached to the wall 26 as discussed above and arranged in the format shown in FIG. 4A. The adjacent panels 10 may have a gap 18 which is the same size as the vertical and horizontal gaps 18 shown in FIGS. 1A and 1B. The underlying vertical joint 22 is revealed through the gap 18. The screws 38 are hidden behind the panels 10. The components may be adjusted so that the gap 18 may be 1/16" to 12".

Additional rows 12 of panels 10 may be stacked upon each other as shown in FIG. 1 until the desired height is reached. The top edge of the wall panel 50, 54 may be finished with a top horizontal edge joint 62 shown in FIG. 1D. The top horizontal edge joint 62 is attached to the wall 26 and engages the upper horizontal clip 32 attached to the panel 10. This locks the panels 10 in place. The top horizontal edge joint 62 is the same as the bottom edge joint 36 except it 62 is upside down compared to joint 36. The top edge joint 62 is revealed. The size of the joint 62 can be adjusted so that the amount that the joint 62 is revealed can be 1/16" to 12".

One or more shims may be placed between the wall 26 and the bottom and top edge joints 36, 62, and the horizontal joint 20 to even out the exterior visible face of the plurality of panels 10. The shims may be held by the screws 38. Additionally or alternatively, one or more shims may be placed between the panels 10 and the horizontal clips 32, 34 to even out the exterior visible face of the plurality of panels 10.

The wall panel system 24 described herein is an eco friendly system. The wall panel system comprises a plurality of panels 10, bottom and top edge joints 36, 62, vertical edge joints 68 and upper and lower horizontal panel clips 32, 34. With these basic components and screws, the panels 10 may be mounted to the wall 26. These basic components may be fabricated from different materials, etc. However, preferably, these basic components are fabricated from the same material (e.g., solid phenolic, medium density fibreboard, particle board, solid wood, bamboo, plastic laminate or a different eco friendly material) to minimize waste and more preferably from the same sheets. Initially, the wall to be covered with the wall panel system 24 is measured. In particular, at least the wall's width and height is measured. To fabricate these components, sheets of material (e.g., phenolic sheets) are initially provided. The sheets may be provided in any thickness (e.g., 5/16" thick to 1½" thick). From these sheets, the panels 10 are initially cut out from the sheets since the panel 10 is typically the larger component in comparison to the bottom and top edge joints 36, 62, vertical edge joints 68 and the clips 32, 34. After the panels 10 are cut out of the sheets, the bottom and top edge joints 36, 62 and the vertical edge joints 68 may be cut out of the left over sheet. In the prior art, the left over sheet is thrown away or discarded. However, the wall panel system 24 utilizes as much of the sheet as possible to minimize waste so as to be an eco friendly process. The grooves 60, 58, 40, the channel 50 and countersink holes 46 and holes 52 may be cut with various processes. By way of example, the grooves 60, 58 and 40 and channel 50 may be formed with a shaper machine.

The wall panel system 24 described herein is also customizable. In particular, FIG. 1 illustrates the wall panel system 24 with the panels 10 being taller than the bottom and top edge joints 36, 62, joints 22, 20 and vertical edge joints 68. However, it is also contemplated that the height and width of the bottom and top edge joints 36, 62, joints 20, 22 and vertical edge joints 68 may be adjusted. By way of example and not limitation, the height of the bottom and top edge joints 36, 62, joints 20, 22 and/or the vertical edge joints 68 may be enlarged so that the gap 18 between the panels 10 may be enlarged. It may be that more of the sheet can be utilized by cutting the bottom and top edge joints 36, 62 and/or the vertical edge joints 68 out of the sheets first before cutting the panels 10. Accordingly, the process of fabricating the kit may be adjusted to yield the maximum amount of pieces to reduce waste.

The panels 10 are shown and described as being square or rectangular. However, other shapes are also contemplated (e.g., circular, pentagonal, etc.) so long as the upper and lower clips 32, 34 can be mounted to the backside of the panels 10 in a parallel manner to each other. The panels 10 can also be cut to any size. For example, the width of the panel may be 1" to 14' wide. The height of the panel may be 1" to 12' high. It is also contemplated that the components of the wall panel system 24 may be fabricated from different materials. Different materials can be used to impart a unique aesthetic look to the system 24. Even when different materials are used for different components of the system 24, the sheets are optimized to minimize waste.

The wall panel system 24 describes various tongue and groove connections. The reverse is also contemplated. By way of example and not limitation, the bottom and top edge joints 36, 62 and the horizontal joint 20 may be fabricated with tongues and the horizontal clips 32, 34 may be fabricated with grooves which mate with the tongues.

The wall panel system 24 may utilize the same component at different areas of the system 24. By doing so, waste and the number of process steps may be minimized. By way of example and not limitation, the horizontal joint 20 may also be used as the vertical joint 22. Also, the bottom edge joint 36 may be used as the top edge joint 62.

In the system 24, the horizontal joint 20, bottom edge joint 36 and the top edge joint 62 have been described and shown as extending across the entire row of panels 10. The vertical joints 22 and the vertical edge joints 68 extend between and abut these components 20, 36, 62. However, the reverse is also contemplated. The vertical joints 22 and the vertical edge joints 68 may extend from the bottom most panel 10 to the top most panel 10. The horizontal joint 20, bottom edge joint and the top edge joint 62 may extend between and abut these components 22, 68.

The system 24 described herein was shown and described as being mounted to a vertical wall. However, it is also contemplated that the system 24 described herein may be mounted to other surfaces other than vertical such as skewed or horizontal (i.e., ceiling).

Figure 5:
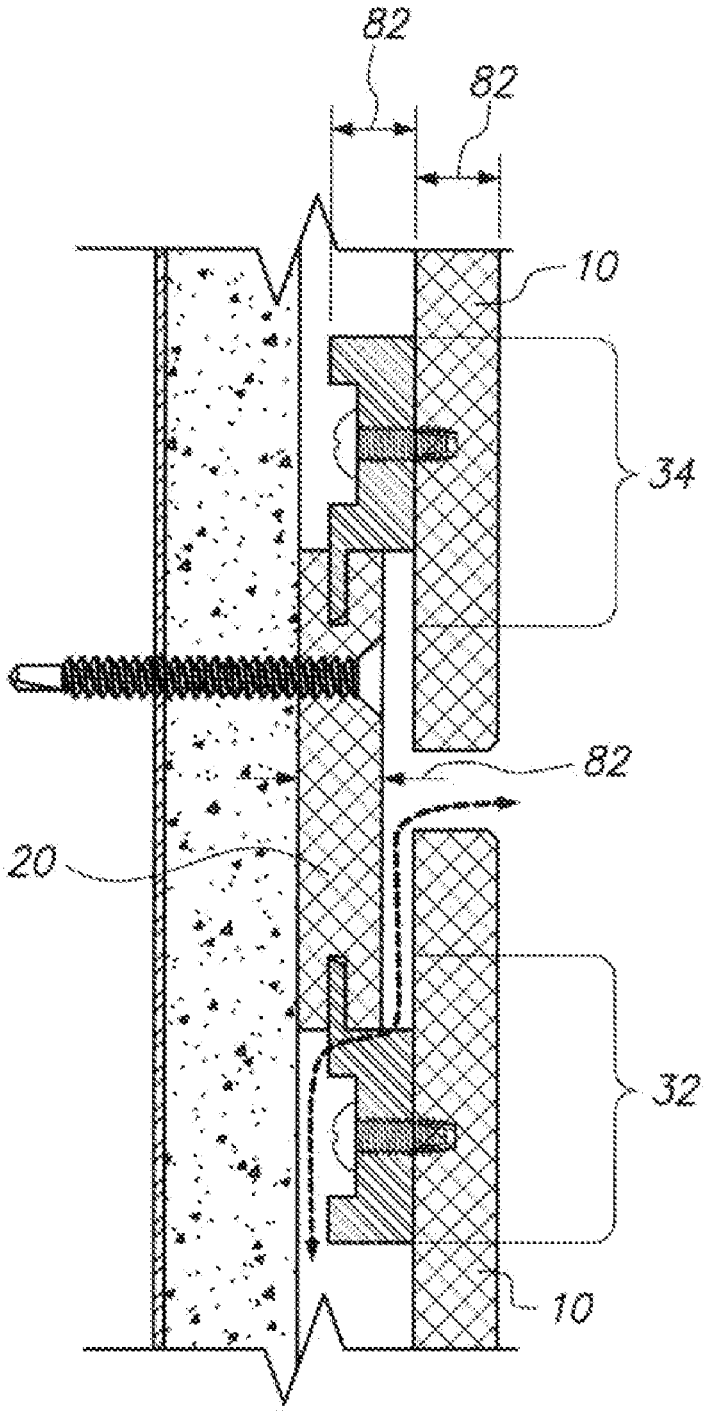
FIG. 5 is a cross-sectional view of a horizontal joint of the system shown in FIG. 1 wherein the upper and lower panel clips, the panels and the horizontal joints have identical thicknesses.

Referring now to FIG. 5, the horizontal joint 20, upper and lower panel clips 32, 34 and the panels 10 each have a thickness 82 which are identical to each other. The horizontal joint 20, the upper and lower panel clips 32, 34 and the panels 10 may all be fabricated from the same sheet of material.

The above description is given by way of example, and not limitation. Given the above disclosure, one skilled in the art could devise variations that are within the scope and spirit of the invention disclosed herein, including various ways of cutting and shaping the components of the kit. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A paneled wall comprising:

a plurality of sheet wall panels, each of the wall panel having a constant thickness from a lower edge portion to an upper edge portion of the wall panel and being solid from the lower edge portion to the upper edge portion, the wall panels arranged in a series of rows and columns on the wall, each of the wall panels disposed parallel to the wall, each of the wall panels having an upper panel clip defining an upwardly directed tongue, the upper panel clips attached to a back side of the panels at upper edge portions of the panels and a lower panel clip defining a downwardly directed tongue, the lower panel clip attached to the back side of the panels at lower edge portions of the panels;

a plurality of sheet horizontal joints, each of the horizontal joints having a constant thickness from a lower longitudinal surface to an upper longitudinal surface and being solid from the lower longitudinal surface to the upper longitudinal surface, each horizontal joint having a length greater than a width of one of the panels, the upper longitudinal surface having an upper groove, the lower longitudinal surface having a lower groove, the horizontal joints attached to the wall horizontal to the ground and parallel to the other horizontal joint(s), the tongue of the lower clip received into the upper groove of the horizontal joint and the tongue of the upper clip received into the lower groove of the horizontal joint;

wherein the wall panels and the horizontal joints have identical thicknesses.

2. The paneled wall of claim 1 wherein the sheets of the wall panels and the horizontal joints are phenolic sheets.

3. The paneled wall of claim 2 wherein at least one of the wall panels and at least one of the horizontal joints are fabricated from the same sheet of phenolic.

4. The paneled wall of claim 1 wherein each of the wall panels does not physically contact another wall panel disposed immediately above or below the wall panel to allow air to flow behind the wall panels.

5. The paneled wall of claim 1 wherein upper and lower surfaces of the wall panels and the rear surfaces of the wall panels are exposed to the atmosphere to allow air to flow behind the wall panels.

6. The paneled wall of claim 1 wherein each of the wall panels does not physically contact another wall panel disposed immediately to the right and left of the wall panel.

7. The paneled wall of claim 1 wherein right and left surfaces of the wall panels are exposed to the atmosphere to allow air to flow behind the wall panels.

8. The paneled wall of claim 1 wherein rear surfaces of the wall panels do not physically contact front surfaces of the horizontal joints.

9. A wall panel kit for installation on a wall, the kit comprising:

a plurality of sheet wall panels, each of the wall panels having a constant thickness from a lower edge portion to an upper edge portion of the wall panel and being solid from the lower edge portion to the upper edge portion of the wall panel, the wall panels arrangeable in a series of rows and columns on the wall, each of the wall panels disposable parallel to the wall, each of the wall panels associable with an upper panel clip defining an upwardly directed tongue when installed, the upper panel clips attachable to a back side of the panels at upper edge portions of the panels and a lower panel clip defining a downwardly directed tongue when installed, the lower panel clip attachable to the back side of the panels at lower edge portions of the panels;

a plurality of sheet horizontal joints, each horizontal joint defining upper and lower longitudinal surfaces, the upper longitudinal surface having an upper groove, the lower longitudinal surface having a lower groove, the horizontal joints attachable to the wall horizontal to the ground and parallel to the other horizontal joint(s), the tongue of the lower clip being receivable into the upper groove of the horizontal joint and the tongue of the upper clip being receivable into the lower groove of the horizontal joint.

10. The wall panel kit of claim 9 wherein the horizontal joints have a length greater than a width of one of the panels.

11. The wall panel kit of claim 9 wherein the wood based sheets of the wall panels and the horizontal joints are phenolic.

12. The wall panel kit of claim 9 wherein at least one of the wall panels and at least one of the horizontal joints are fabricated from the same sheet of phenolic.

* * * * *